US007198208B2

(12) United States Patent
Dye et al.

(10) Patent No.: US 7,198,208 B2
(45) Date of Patent: Apr. 3, 2007

(54) FUEL INJECTION ASSEMBLY

(76) Inventors: Anthony Osborne Dye, 48 Thornton Court, Girton Cambridge (GB); Mark Schofield, Jubilee Place Heath Road Woolpit, Bury St. Edmunds Suffolk (GB); Rachel Patience Groves Harker, 2 Wellsic Lane, Rothley Leicester (GB); Harold Morser, 66 Lower Road, West Malvern (GB)

( * ) Notice: Subject to any disclaimer, the term of this patent is extended or adjusted under 35 U.S.C. 154(b) by 289 days.

(21) Appl. No.: 10/399,722

(22) PCT Filed: Oct. 18, 2001 (Under 37 CFR 1.47)

(86) PCT No.: PCT/GB01/04646

§ 371 (c)(1), (2), (4) Date: Jan. 16, 2004

(87) PCT Pub. No.: WO02/33245

PCT Pub. Date: Apr. 25, 2002

(65) Prior Publication Data

US 2004/0149256 A1 Aug. 5, 2004

(30) Foreign Application Priority Data

Oct. 19, 2000 (GB) ..... 0025668.5

(51) Int. Cl.
*B05B 5/00* (2006.01)
*F23D 11/32* (2006.01)

(52) U.S. Cl. ..... 239/708; 239/533.12; 239/556; 239/584; 239/585.1; 239/690; 239/696; 123/536; 123/538

(58) Field of Classification Search ..... 239/3, 239/5, 88–96, 533.3–533.12, 690, 696, 708, 239/584–585.5, 556–558; 123/536, 538
See application file for complete search history.

(56) References Cited

U.S. PATENT DOCUMENTS

| | | | | |
|---|---|---|---|---|
| 3,361,353 | A * | 1/1968 | Millman | 239/5 |
| 4,077,374 | A * | 3/1978 | Willmann et al. | 123/536 |
| 4,150,644 | A * | 4/1979 | Masaki et al. | 239/696 |
| 4,508,265 | A * | 4/1985 | Jido | 239/3 |

(Continued)

FOREIGN PATENT DOCUMENTS

| | | |
|---|---|---|
| DE | 1962917 | 7/1996 |
| FR | 900408 | 12/1943 |

*Primary Examiner*—Steven J. Ganey
(74) *Attorney, Agent, or Firm*—Luedeka, Neely & Graham PC

(57) ABSTRACT

A fuel injection assembly comprising a main structure (101) for mounting on an internal combustion engine, the main structure having one or more orifices (115) for injecting fuel directly into the combustion chamber of the internal combustion engine, and the main structure also having mounted thereon charge electrodes (105, 118) positioned to provide an electric field which passes through the flow of fuel, for charging fuel particles to improve atomisation. The main structure also has mounted thereon a spark electrode (104) adapted to provide a fuel ignition spark for the internal combustion engine. The main structure of the assembly is adapted for removable mounting, having a threaded portion (102) adapted to co-operate with a threaded aperture in the internal combustion engine, normally adapted to receive a convention spark plug.

5 Claims, 6 Drawing Sheets

U.S. PATENT DOCUMENTS 4,865,003 A * 9/1989 Scharnweber et al. ..... 123/538
5,234,170 A * 8/1993 Schirmer et al. ..... 239/690
5,297,738 A * 3/1994 Lehr et al. ..... 239/708
5,725,151 A * 3/1998 Hetrick et al. ..... 239/690

* cited by examiner

FUEL INJECTION ASSEMBLY

The present invention relates to a fuel injection assembly.

It is known to provide, for example as disclosed in U.S. Pat. No. 5,234,170, means for achieving finely divided atomisation of fuel from an injector into the cylinder of an internal combustion engine, known as the charged injection process. The means consists essentially of a pair of electrodes situated on either side of the delivery orifice of a fuel injector. These electrodes supply a high voltage, low current charge to the fuel stream as it passes through the orifice. This causes the behaviour of the fuel stream as it leaves the orifice to change very substantially when compared with its behaviour in the absence of the electrostatic charge. In the absence of electrostatic charge, the concentrated fuel stream proceeds some distance from the injector before beginning to break up into sub-streams and eventually droplets. It is found that the electrostatic charge causes the stream to break up close to the orifice and form small droplets, which are charged and which therefore repel each other and scatter rapidly to form a mist or aerosol extending widely into the confined volume of the cylinder. It is also disclosed that this process of greatly enhanced atomisation of the fuel stream occurs effectively with much reduced delivery pressure compared with those pressures conventionally used in direct injection fuel injectors.

In DE-A-19629171 there is disclosed a known juxtaposition of a fuel atomisation device and a spark plug in the cylinder head of an internal combustion engine. The ignition system has a system for producing a fuel cloud in a combustion chamber and a spark plug projecting in the combustion chamber. The system for producing the fuel cloud includes an ionising electrode for the electrical charging of the fuel cloud. The spark plug has no earth electrode. The system for producing the fuel cloud may have an injection valve, or can be a carburettor. The system for electrically charging the fuel cloud may have a laser. The spark plug and the electrical charging device are mounted separately in the cylinder head of the engine.

In recent years, a new genus of spark ignition, gasoline fuelled internal combustion engine has grown which is known as the Gasoline Direct Injection (GDI) Engine. These engines are characterised by having the gasoline fuel injected directly into the cylinder via an injector the delivery orifices of which are located in the combustion chamber. In such engines, the fuel is delivered either all in one pulse or in a number of pulses phased through the period of the induction and compression strokes or, in the case of 2-stroke GDI versions, through the compression phase only. In all cases, there is less time for full atomisation of the fuel to take place than is the situation in previous forms of spark ignition gasoline engines where the air/fuel mixture has been prepared externally from the cylinder. It has therefore been a feature of the art in GDI engines to locate the injector in the most favourable position and to use the spray pattern most effectively so as to achieve the most rapid vaporisation of the fuel which is possible within the limitations which are imposed by the requirement to deliver the fuel directly into the cylinder. This means that the most favoured location for the injector nozzle is central within the combustion chamber. This is also the most favoured location of the spark plug.

In FR-A-900408 (Jezler) there is disclosed a fuel injection assembly for mounting on an internal combustion engine. A combined spark plug and fuel atomiser is provided in which fuel passes through a spark plug to a fuel atomisation chamber in an inner end of the spark plug. The dimensions of the chamber are selected so that the fuel is retained by the effect of capillarity. A high tension spark voltage is applied across the fuel atomisation chamber. The effect of this voltage pulse across the stationary fuel in the atomisation chamber is that the fuel is strongly heated, dissociated and ionised by the current, producing an explosive action by which the fuel is expelled out of the chamber into the combustion chamber of the engine. The device is connected externally by two electrical connectors comprising a conventional HT terminal and a conventional threaded earth connection into the cylinder block of the engine. A single potential difference is provided for both atomising and igniting the fuel.

It is an object of the present invention to provide a fuel injection assembly which allows the favourable positioning of various components necessary to the operation of an internal combustion engine, in the most favourable locations in the combustion chamber.

According to the present invention there is provided a fuel injection assembly comprising a main structure for mounting on an internal combustion engine, the main structure having an array of orifices for injecting fuel directly into the combustion chamber of the internal combustion engine, the main structure also having mounted thereon an electrode structure for atomising and igniting the fuel including a spark electrode adapted to provide a fuel ignition spark for the internal combustion engine, in which the electrode structure includes charge electrodes positioned to provide an electric field which passes through a flow of fuel for charging fuel particles in the flow to improve atomisation, and the main structure has three electrical connectors adapted to be connected externally to three different potentials, and being connected to said electrodes to allow provision of a relatively low potential difference for atomising the fuel and a relatively high potential difference for igniting the fuel.

Preferably the main structure is adapted for removable mounting on an internal combustion engine so as to protrude into the combustion chamber of the engine. Conveniently the main structure has a threaded portion adapted to cooperate with a threaded aperture in an internal combustion engine adapted to receive a conventional spark plug. Also conveniently the main structure has an inner portion of insulating material and an outer portion of conducting material adapted to be secured to the main casing of an internal combustion engine.

Normally in embodiments of the invention it will be arranged that the main structure has an internal region adapted to be positioned in communication with the interior of a combustion chamber when the structure is mounted on an internal combustion engine, and an external region adapted to be external to the combustion chamber when the main structure is mounted on the engine. Conveniently the assembly includes a fuel supply passage passing through the main structure from a fuel supply inlet positioned at the external region of the main structure, to the said fuel injection orifice or orifices, which are positioned at the said internal region of the main structure.

Conveniently the spark electrode is exposed from the main structure at the said internal region thereof, and passes through the main structure to an electrical connector means at the external region of the main structure, for connection to a high tension voltage lead.

In one particularly preferred form the said spark electrode is electrically connected to a first of the said charge electrodes. Preferably the spark electrode is connected to the first charge electrode by a connection positioned within the main body. In a particularly preferred form according to the invention, it is arranged that the assembly includes a voltage supply unit arranged to supply varying potentials to the spark electrode and to a second of the charge electrodes, the voltage supply unit being arranged to vary the potentials supplied during a firing cycle of an internal combustion engine so as to maintain a potential difference between the first charge electrode and the second charge electrode at a first, constant, value for atomisation of fuel, and to provide a potential at the spark electrode which varies between a first preselected value sufficiently small to avoid generation of an ignition spark, and a second preselected value sufficiently large to provide an ignition spark.

In preferred arrangements according to the invention, the said spark electrode is a primary spark electrode, and there is provided on the main structure at least one secondary spark electrode spaced apart from the primary spark electrode to provide a fuel ignition spark for the internal combustion engine; the said charge electrodes comprising at least one primary charge electrode and at least one secondary charge electrode, spaced apart across a fuel flow path of the assembly. It is to be appreciated that there may be provided more than one primary spark electrode, but it is conveniently found that a single primary spark electrode is sufficient.

Preferably the spacing between a primary charge electrode and an associated secondary charge electrode is a distance in the range 25 microns to 500 microns, most preferably in the range 125 microns to 200 microns. In one preferred form the spacing is 150 microns.

Conveniently the primary spark electrode is electrically connected to an ignition source connector mounted on the main body and adapted to be connected to a source of ignition potential to provide a fuel ignition spark for the internal combustion engine. Conveniently the ignition source connector may comprise a conventional high tension terminal as found on a conventional spark plug. Also conveniently it is provided that the said at least one secondary spark electrode is connected to an earth portion of the assembly adapted to be earthed to a casing of an internal combustion engine.

In one form of the invention it may be arranged that the said at least one secondary charge electrode is connected to an earth portion of the assembly adapted to be earthed to a casing of an internal combustion engine, and the said at least one primary charge electrode is connected to a charge source connector mounted on the main body and adapted to be connected to a source of potential for providing the said atomisation of fuel. However this form is not preferred. In a preferred form according to the invention the said at least one primary charge electrode is electrically connected to the said primary spark electrode, and the said at least one secondary charge electrode is connected to a charge source connector mounted on the main body and adapted to be connected to a source of potential for providing the said atomisation of fuel. Preferably the said at least one primary charge electrode is connected to the said primary spark electrode by a connection positioned within the main body.

In operation, it will conveniently be arranged that primary spark electrode is electrically connected to a source of ignition potential to provide a fuel ignition spark for the internal combustion engine, and that the said at least one secondary spark electrode is connected to an earth portion of the assembly adapted to be earthed to a casing of an internal combustion engine. In a particularly preferred form according to the invention the assembly includes a voltage supply unit arranged to supply varying potentials to the primary spark electrode and to the secondary charge electrode, the voltage supply unit being arranged to vary the potentials supplied during a firing cycle of an internal combustion engine so as to maintain a potential difference between the primary charge electrode and the secondary charge electrode at a first, constant, value for atomisation of fuel, and to provide a potential difference between the primary spark electrode and the said at least one secondary spark electrode which varies between a first preselected value sufficiently small to avoid generation of an ignition spark, and a second preselected value sufficiently large to provide an ignition spark.

Preferably the said first value lies in the range 2 to 14 kV, most preferably in the range 5 to 8, and preferably the second value lies in the range 10 to 50, most preferably in the range 35 to 45 kV.

In a particularly preferred form, the main structure includes an annular distribution gallery positioned around a central axis of the main structure, the said at least one primary charge electrode providing an annular edge facing into the distribution gallery and the said at least one secondary charge electrode being positioned in an annular configuration around the distribution gallery on a surface of a wall thereof. Preferably the said injection orifices are directed outwardly from the annular distribution gallery.

It is also preferred that the said primary spark electrode is aligned along a central longitudinal axis of the main structure. Conveniently the said primary spark electrode produces the ignition spark of the internal combustion engine in co-operation with a plurality of secondary spark electrodes distributed around the said main longitudinal axis.

It may occur that there is difficulty in electrical leakage in the main structure of the assembly, between the spark electrode, and conductors leading to the charge electrode. To avoid this, it is preferred the said main structure includes within the interior of the structure an electrostatic shield member extending between the said spark electrode and electrical conductors leading to the said charge electrode.

It is to be appreciated that where features according to the invention have been set out herein with reference to a fuel injection assembly, these features may also be provided in accordance with a method of injecting and igniting the fuel in an internal combustion engine, and vice versa. In particular there may be provided in accordance with another aspect of the invention a method of injecting and igniting the fuel in an internal combustion engine comprising the steps of injecting fuel directly into the combustion chamber of the internal combustion engine through an array of orifices positioned in a main structure of a fuel injection assembly mounted on the internal combustion engine; and supplying current to an electrode structure mounted on the main structure for atomising and igniting the fuel, including supplying a pulsed potential to a spark electrode of the electrode structure to provide a fuel ignition spark for the internal combustion engine; the method including supplying a potential difference across charge electrodes of the electrode structure positioned to provide an electric field which passes through a flow of fuel for charging fuel particles in the flow to improve atomisation; and the method including supplying a relatively low potential difference for charging the fuel particles to improve atomisation and a relatively high potential difference to provide the fuel ignition spark.

In a preferred form of the method according to the invention, it may be provided that the spark electrode is electrically connected to a first of the charge electrodes, and that the method includes supplying varying potentials to the spark electrode and to a second of the charge electrodes, varying the potentials supplied during a firing cycle of the internal combustion engine so as to maintain a potential difference between the first charge electrode and the second charge electrode at a first, constant, value for atomisation of fuel, and so as to provide a potential at the spark electrode which varies between a first preselected value sufficiently small to avoid generation of an ignition spark, and a second preselected value sufficiently large to provide an ignition spark.

Embodiments of the invention may provide an application of the enhanced atomisation and vaporisation capability of the charged injection process encapsulated within a single unit which also acts as a conventional spark plug. Thus, the two functions of fuel delivery with atomisation, and spark ignition, can be performed from a single unit which can be screwed into a standard spark plug orifice in the location in the combustion chamber which is most favourable for both of these functions.

Embodiments of the invention will now be described by way of example with reference to the accompanying drawings in which:

FIG. 1 is a cross-section along a longitudinal axis through a fuel injection assembly constituting a first embodiment of the invention;

FIG. 1*a* is an enlargement of the cross-section in the region where the precise location of fuel delivery orifices in relation to the active tip of the charge electrode is shown;

Figure 1:
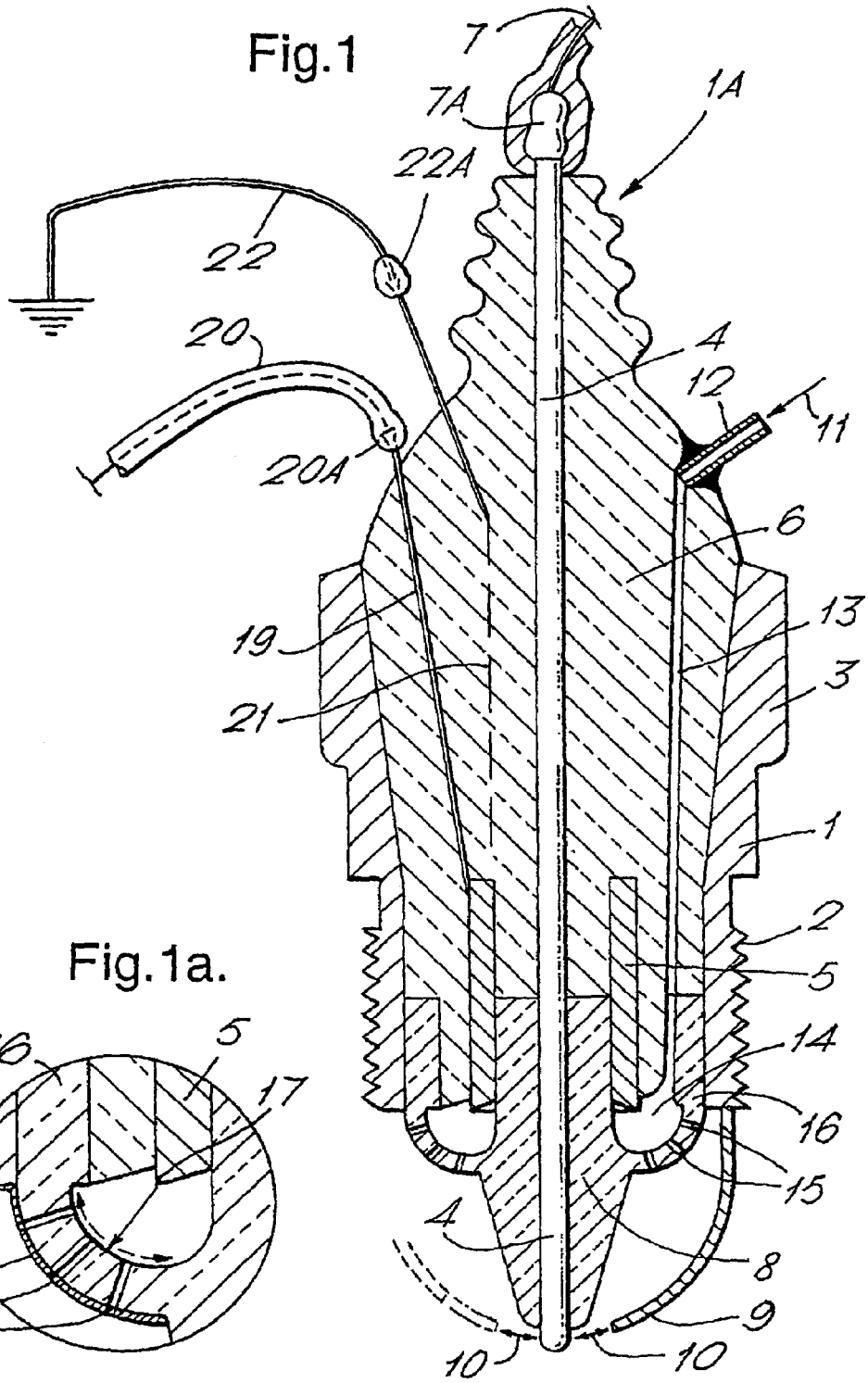
Figure 3:
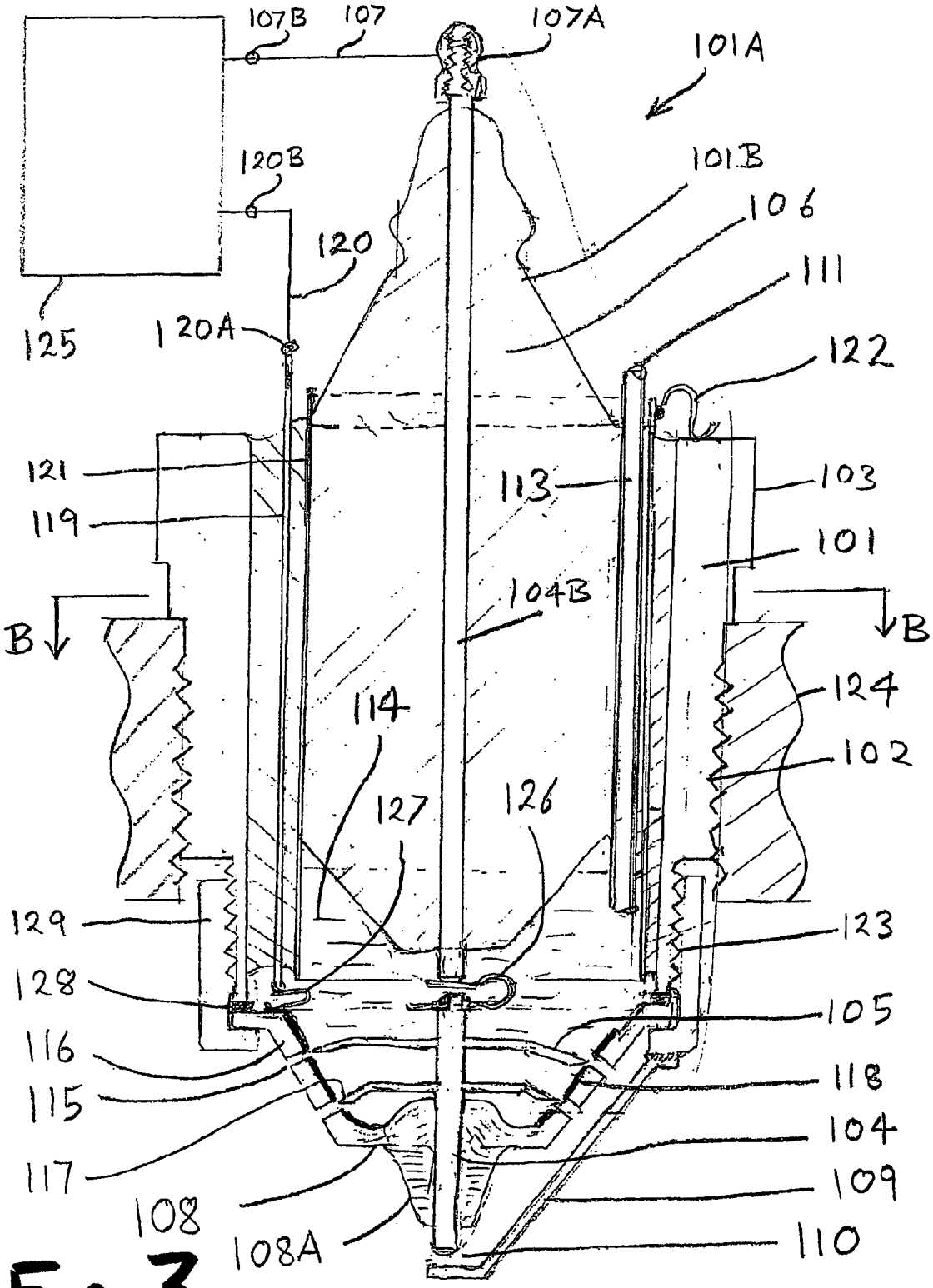
FIG. 3 is a cross-section along a longitudinal axis through a further fuel injection assembly which shows modifications from the assembly of FIG. 1, and which is a preferred embodiment of the invention.
Figure 3A:
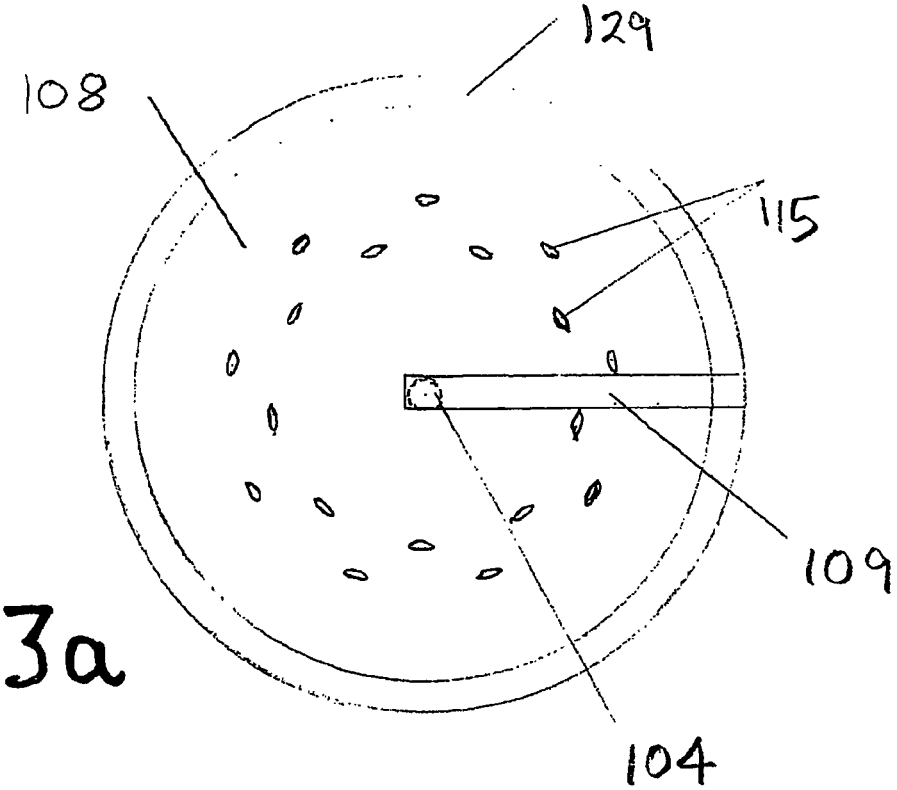
Figure 3B:
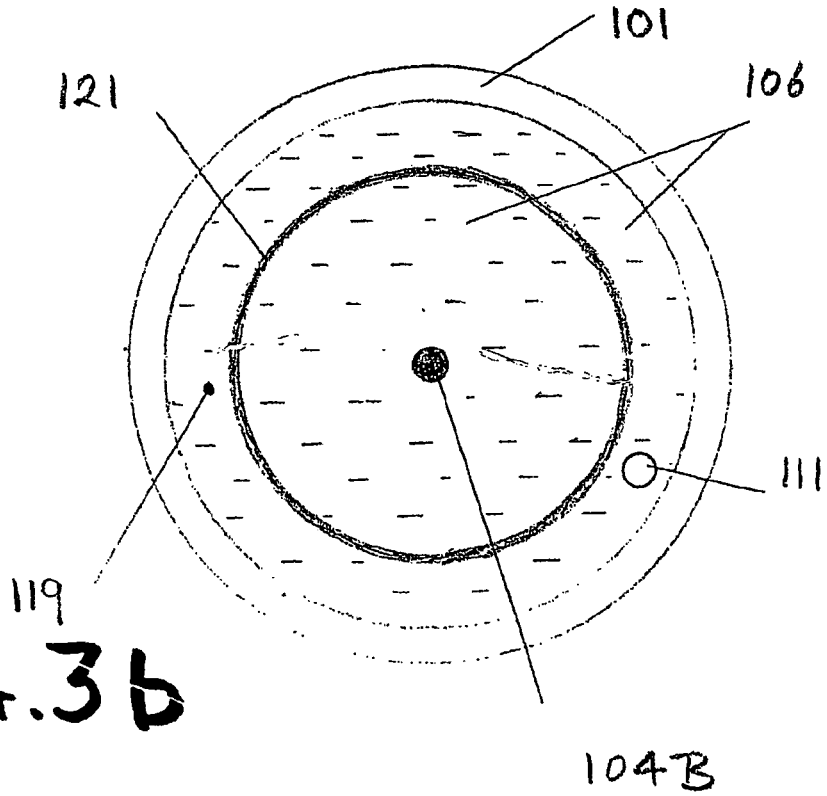
Figure 4:
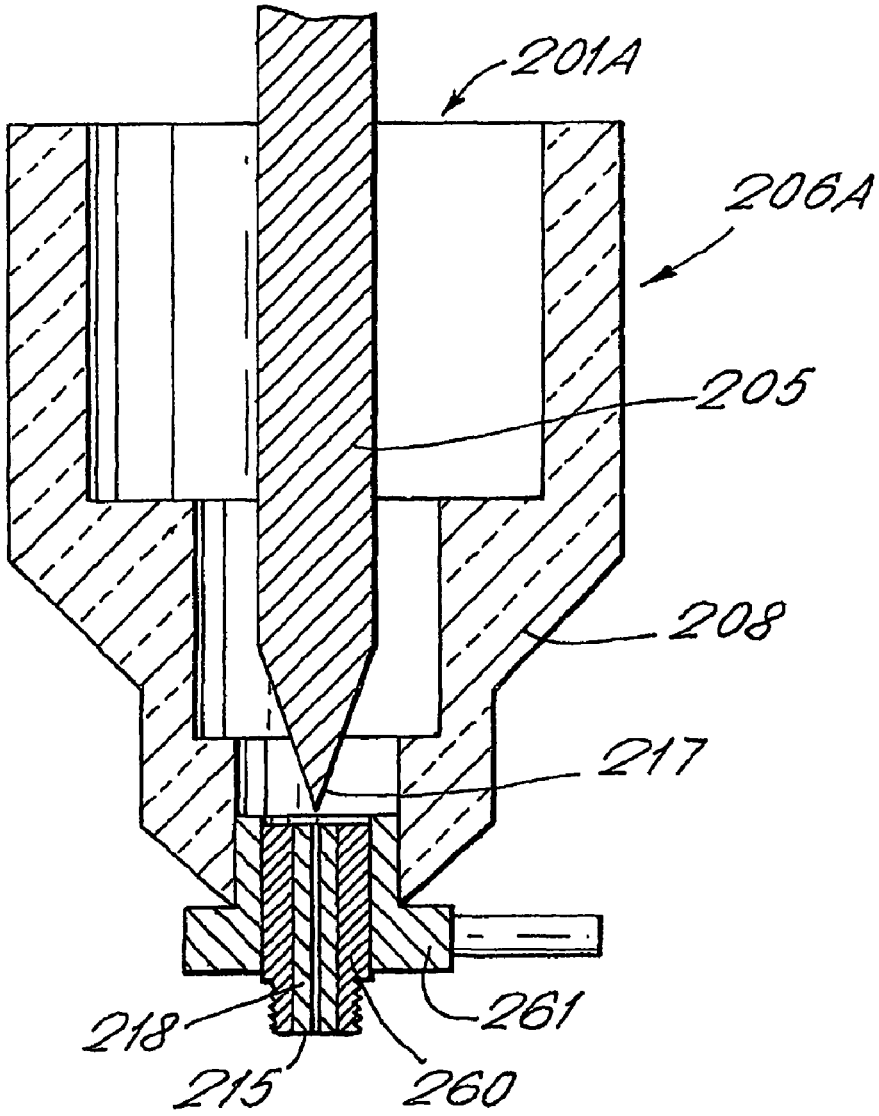
Figure 4B:
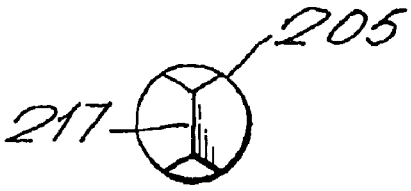
Figure 4A:
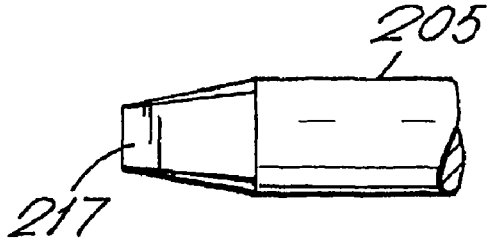
Figure 5:
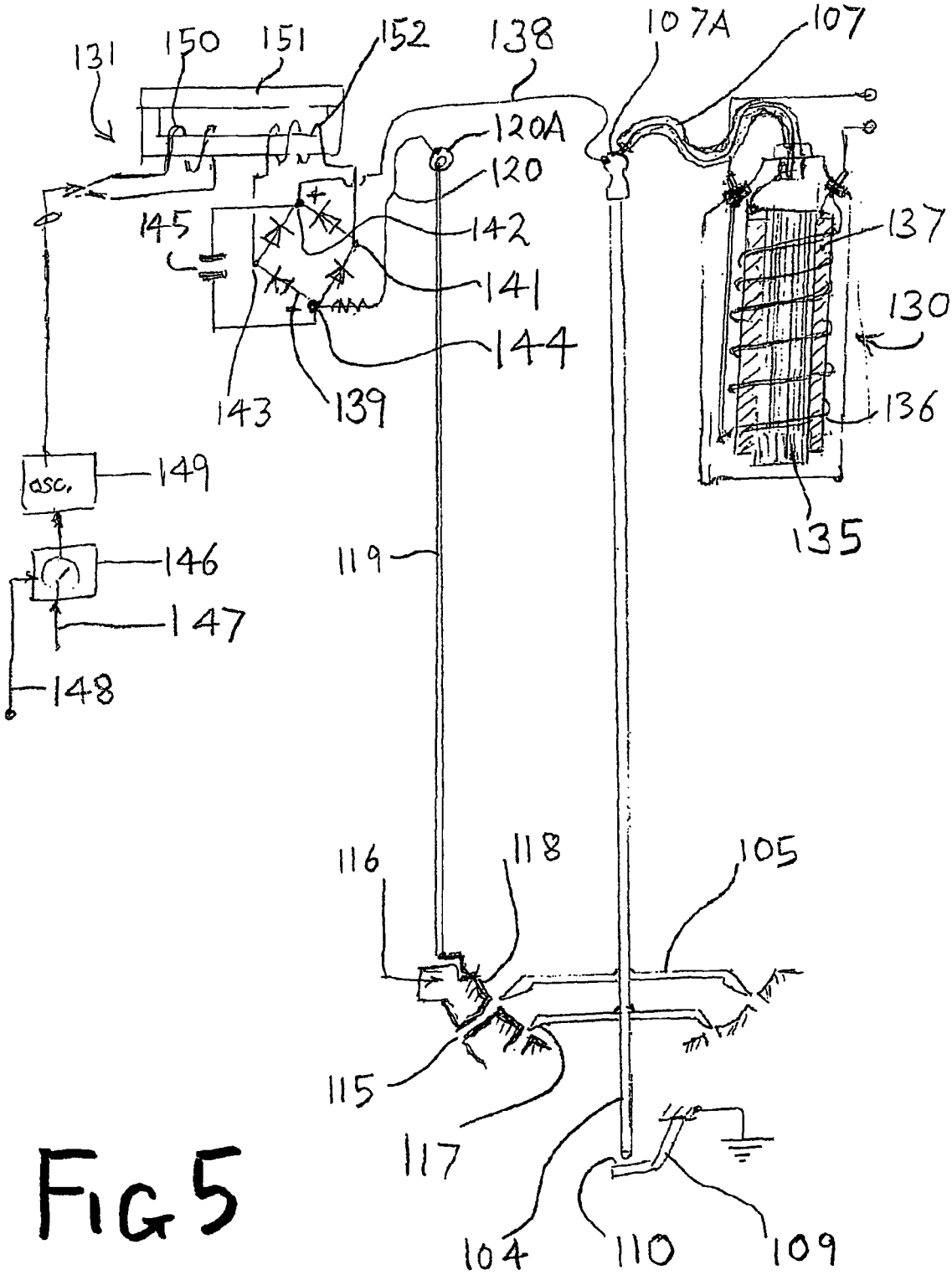

FIG. 3*a* is a plan view from below of the fuel injection assembly shown in FIG. 3, and FIG. 3*b* is a cross-section on the lines B—B in FIG. 3;

FIG. 4 is a cross-section along a longitudinal axis through a test rig utilised in determining the spacing of various electrodes shown in the embodiment of FIG. 3, FIG. 4*a* shows a side view of a tip of an electrode shown in FIG. 4, and FIG. 4*b* shows an end view of the electrode tip; and FIG. 5 is a diagrammatic circuit diagram of one form of voltage supply assembly which may be utilised in association with the fuel injection assembly of FIG. 3 embodying the invention;

A first embodiment shown in cross-section in FIG. 1 consists of a combined spark ignition and fuel atomisation device constituted by a main structure indicated generally at 1A. An inner insulating portion 6 is contained by a metal outer casing 1 having a standard spark plug thread 2 and hexagonal periphery at 3 enabling the device to be screwed into a spark plug hole provided in the combustion chamber (not shown). A spark electrode 4, constituting a primary spark electrode, and a cylindrical electrostatic discharge electrode 5, constituting a primary charge electrode, are supported concentrically within the main ceramic insulator 6 which fills most of the space contained within the outer casing 1.

The spark electrode 4 is connected externally to a conventional HT (high tension) ignition lead having a capacity typically of approximately 40 kV. At the inner tip of the device, the spark electrode 4 is protected by the ceramic insulation material which forms a removable dual function cap 8 of the device. A small number, preferably not less than three, earth electrode extensions 9, are equally spaced around the inner end of the device and constitute secondary spark electrodes. Each of the spark gaps 10 is initially set to be of equal length. This provides spark gaps with a length which will tend to remain substantially constant over the life of the device because any tendency for the spark to persistently occur via one only of the earth electrode extensions 9, will result in erosion of that electrode which will cause an increase in its spark gap. This gives a consequent increase in resistance to the earth path which it affords, which will then favour one or other of the alternative earth paths afforded by the other earth electrode extensions 9.

Figure 1A:
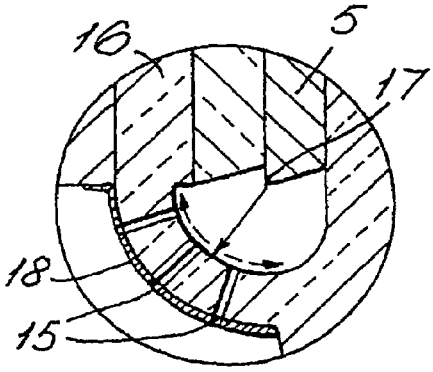

A petrol fuel supply 11 is routed through the device via a metal ripple 12 leading to a cored hole 13 which is formed through the ceramic insulator 6 prior to the firing stage of manufacture. The cored hole 13 conducts the fuel into an annular distribution gallery 14 in the dual function cap 8. Numerous orifices 15 perforate an outer wall 16 of the distribution gallery 14. The positions of the orifices 15 are such that the fuel streams to which they give rise during the periods of delivery pas between the earth electrode extensions 9. The arrangement of the orifices 15 in relation to an annular active edge 17 of the primary charge electrode 5 is shown in greater detail in FIG. 1*a*. The orifices are arranged in an arc such that fuel is distributed through a wide field in the cylinder downwards toward the piston. The inner and outer surfaces of the distribution gallery 14 are concentric with the active edge 17 of the primary charge electrode 5 to within a tightly limited tolerance. The outer surface of the distribution gallery 14 is coated with a conductive metallised skin 18 which is permanently attached to the ceramic surface via a molecular bond. This metallised skin extends to the end of the threaded part of the outer casing 1 thus providing a ground return for the electrostatic charge. The metallised skin 18 constitutes a secondary charge electrode for producing, with the primary charge electrode 5, the electrostatic discharge for producing atomisation of fuel.

The electrostatic discharge is effected from the active edge 17 of the charge electrode 5 by means of an electric pulse excitation along a lead 20 in the order of 10 kV which is delivered to the charge electrode 5 via a conductor 19 through the ceramic insulator 6 from an oscillator (not shown). The lead 20 is connected to the conductor 19 at an electrical connector 20A in the form of a conventional electrical terminal. In general the arrangement and operation of the charge electrodes 5, 18 may be as set out in U.S. Pat. No. 5,234,170. The charge electrode 5 is protected from inadvertent excitation which might otherwise arise as a result of leakage through the ceramic insulator, by means of an electrostatic shield 21 which consists of a strip of copper of approximately 25 microns thickness located within the ceramic insulator 6. The shield 21 extends from a position close to the top of the charge electrode 5 to a point in the upper part of the ceramic insulator 6 where the conductor 19 is so distant from the spark electrode 4 as to provide no further risk of HT ignition voltage leakage. The upper end of the electrostatic shield 21 is connected via an earth lead 22 and external connector 22A to a convenient earth point.

During operation of the device, fuel is supplied from a delivery system (not shown) which incorporates a standard means of supply of fuel at a pressure within the range 2 to 10 Bar, via a metering control of standard type (also not shown) which can typically be operated by a solenoid control valve with electronic means of control providing a variable period of opening according to the fuelling regime required by the particular engine in which the device is installed. Switching of an excitation pulse to initiate or terminate charge delivery from the charge electrode 5 can also be controlled electronically, preferably via a sensor signal from a pressure transducer (not shown) which is able to detect the existence of sufficient pressure in the fuel delivery supply 11 to cause fuel flow through the device. In this way, the electrostatic charge delivery only takes place when a flow of fuel is established through the orifices 15. At all other times, activation of discharge from the charge electrode 5 is protected by means of the electrostatic shield 21. Thus any inadvertent sparking which might initiate a combustion event as a result of HT activity is effectively prevented.

Figure 2:
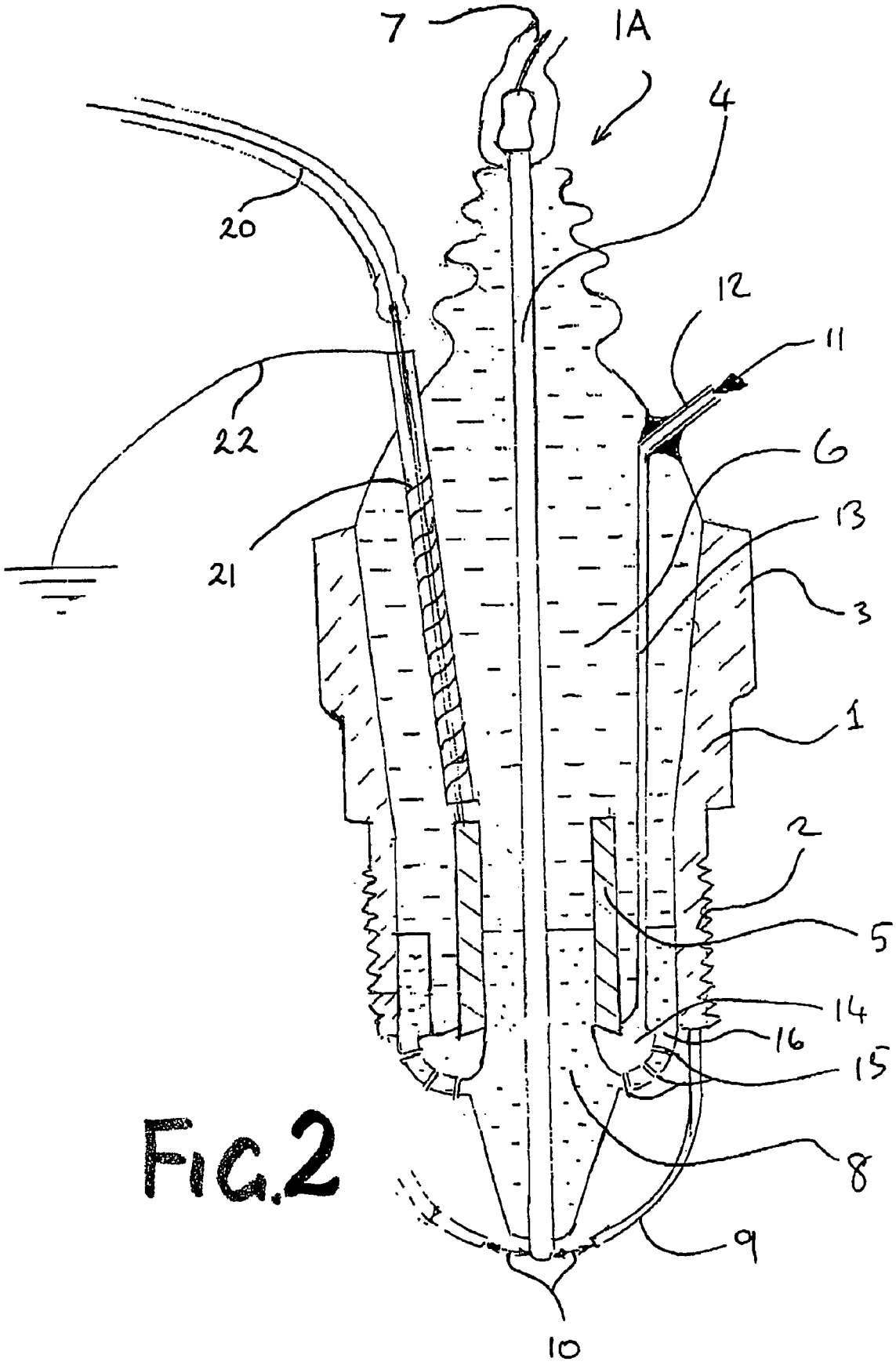
FIG. 2 is a cross-section through a second embodiment of the invention.

FIG. 2 shows a further preferred embodiment of the invention in which the electrostatic shield 21 is formed as a helical earth shield around the conductor 19. This extends for a substantial portion of the conductor length, over which exists the risk of leakage from the HT ignition source. The helical shield 21 extends to a point close to the lower end of the conductor 19 where it will continue to afford protection from HT leakage while maintaining an adequate insulating distance from the charge electrode 5 and the conductor 19.

FIGS. 3, 3*a* and 3*b*, show a further, and preferred, embodiment of the present invention incorporating modifications of the embodiment shown in FIG. 1. Where components in FIG. 3 correspond generally to components in FIG. 1, these are indicated by like reference numerals but starting at a base of 100. It is particularly to be noted that FIG. 3*c* is not drawn to scale. The diameters of the cylindrical components are exaggerated by a multiple of approximately 2.5 compared with axial parameters of the assembly.

Referring firstly to FIG. 3, a fuel injection assembly embodying the invention has a main structure 101A consisting of an upper structure 101B and a lower cap 108, the two being joined together in use at a threaded junction 123. The upper structure 101B has an inner insulating portion 106 contained by a metal outer casing 101 having a standard spark plug thread 102 and hexagonal periphery at 103 enabling the device to be screwed into a spark plug hole provided in the cylinder head wall 124 of an internal combustion engine.

The main structure 101A has an array of orifices 115 in the lower cap portion 108 for injecting fuel directly into the combustion chamber. The main structure 101A also has mounted thereon primary charge electrodes 105 and secondary charge electrodes 118 positioned to provide an electric field which passes through the flow of fuel for charging fuel particles passing through the perforations 115 to improve atomisation. The main structure 101A also has mounted thereon a primary spark electrode 104 and secondary spark electrode 109, adapted to provide a fuel ignition spark for the internal combustion engine.

The primary spark electrode 104 is connected internally through the main structure 101A to an ignition source connector 107A which may be a conventional electrical terminal of the kind used on a conventional spark plug. The primary charge electrodes 105 are connected internally within the main structure 101A to the primary spark electrode 104. The secondary charge electrodes 118 consisting of the conductive skin, are connected by way of a conductor 119 through the main structure 101A to a charge source connector 120A which again may be a conventional electrical terminal.

The secondary spark electrode 109 is connected directly to the metal outer casing 101, and is earthed through the connection of the casing 101 to the cylinder head block 124 by the thread 123. The spark gap between the primary spark electrode 104 and secondary spark electrode 109 is indicated at 110. To prevent leakage between the primary spark electrode 104 and the conductor 119 there is provided an electrostatic shield member 121. The electrostatic shield member 121 is connected to earth by an electrical connection known as a pigtail, indicated at 122.

A petrol fuel supply is fed along a fuel feed line 111 leading through a cored hole 113 which is formed through the ceramic insulator 106 prior to the firing stage of manufacture. The fuel supply hole 113 leads to an annular distribution gallery 114 from which the orifices 115 lead outwardly through an outer wall 116 of the distribution gallery 114. The potentials required for the primary spark electrode 104 and secondary charge electrodes 118, are provided respectively along an HT lead 107 leading to the terminal 107A, and along an electrical lead 120 leading to the terminal 120A. The leads 107 and 120 are connected to output terminals 107B and 120B of a voltage supply assembly 125, to be described in more detail hereinafter.

The required electrical connections between components in the upper supporting structure 101B and the cap 108 are made by spring metal strips which make electrical contact when the cap 108 is screwed onto the upper supporting structure 101B. The primary spark electrode 104 has at its upper end a U-shaped spring strip 126 secured thereto which is biased openly in the upward direction so as to make good electrical contact with an HT conducting rod 104B which passes through the inner insulating portion 106 of the upper supporting structure 101B and leads to the terminal 107A. Similarly a spring strip 127 is fixed to an upper region of the metallic layer 118 which constitutes the secondary charge electrode. The spring strip 127 is similarly a U-shaped spring strip biased openly and upwardly so as to bear against the conductor 119 when the upper supporting structure 101B and cap 108 are screwed together. A sealing ring 128 is provided between the lower end of the metal casing 101 and the upper end of the wall 116 of the distribution gallery 114, to provide a seal against leakage of fuel in the gallery 114.

There is substantial advantage in manufacturing the assembly in two separable parts. The upper main supporting structure 101B contains the central conducting element 104B which carries the high voltage power to the electrodes. The conductor 104B is surrounded by the ceramic insulation material 106 contained within the outer metallic cylindrical wall 101. This wall is externally threaded at its lower end 123 to enable attachment of the lower section, which is formed as the separate cap assembly 108. The cap contains the electrodes for both spark ignition of the fuel/air mixture in the combustion chamber and for electrostatic charging of the fuel prior to its delivery into the combustion chamber. The cap is fabricated in ceramic material 116, 108A which supports the electrodes 105, 104 in correct position. The ceramic portion is attached to an internally threaded cylindrical metal support 129 which enables it to be screwed into position where the components of the cap can communicate with the services provided in the upper structure 101B.

FIG. 3*a* is an axial view from the combustion chamber end, of the lower cap part 108 of the injector/atomiser. It shows a cup-shaped ceramic part 108A, which is perforated by two rings of orifices 115 and supported by an internally threaded metal cylindrical outer part 129. Eighteen orifices 115 are shown, equally spaced peripherally and so that the fuel jets which are emitted do not interfere with the earth electrode 109 for the ignition spark system.

FIG. 3*b* is an axial section at lines B—B through the upper main supporting structure of the injector/atomiser. It shows the ceramic insulating material 106, which fills most of the volume contained by the outer metallic cylindrical wall 101 and supports in position the following components, namely: the central high voltage power conductor 104B, the electrostatic shield tube 121, the polarising voltage conductor 119, and the fuel feed line 111.

The positions of the central high voltage power conductor 104B and the electrostatic shield tube 121 are axi-symmetrical but the positions of the polarising voltage conductor 119 and the fuel feed line 113 do not require to be precisely determined. Thus, during the compression and firing phases of manufacturing the assembly, the positions of the latter two components may move slightly without harming the efficacy of the whole assembly.

The upper main structure 101B has the second external thread 102 applied on its outer wall 101. This must be above, and at a larger radius than that of the outside of the lower cap section 129. Thus, the whole assembly 101A may be screwed into the threaded orifice commonly provided in the cylinder heads of spark ignited engines, for the spark plug.

Returning to consideration of the secondary charge electrodes 118, the metallising surface conductor 118 on the lower ceramic cap 108, which connects with the polarising voltage conductor 119 in the upper structure 101B, is confined to the inner surface only of the ceramic cap, where it forms the secondary electrode for the electrostatic ionising system. The gap between the ionising power supply electrode 105 and the secondary electrode 118 is thus seen clearly as the gap between the tip 117 of the primary electrode and the inner surface 118 of the ceramic wall 116 where it surrounds an orifice 115. This gap must be substantially equal for all of the orifices.

The main modification shown in FIG. 3 compared with FIG. 1, is that the fuel atomisation elements and the ignition spark generation elements share a common electrode. The additional secondary electrode 118 is provided for the fuel atomisation elements, whilst the secondary electrode 109 for the spark ignition remains as previous disclosed in FIG. 1, in the form of a protrusion 109 from the outer casing 101 of the assembly, thus providing an earth electrode.

It is commonly understood, that at a certain point in the engine cycle of a typical spark-ignited engine, when the piston is just about to reach TDC (top dead centre), a spark plug is activated. A potential difference of approximately ±40 kV (ranging from 10 kV to 50 kV depending on the individual device) is applied between the electrode of the spark plug and its earth casing. This causes an electrical break-down, in the form of a visible arc or spark, in the engine cylinder, across the fuel air mix, which results in ignition of the fuel. Thus, throughout the engine cycle, a conventional spark plug electrode is held at OV then pulsed to approximately ±40 kV at the ignition point, and returned to OV after the spark discharge. The secondary electrode consists of the earthed casing of the plug, which is always maintained at OV.

In the device illustrated in FIG. 3, the single shared electrode system 104 and 105 will be maintained at −7 kV throughout the majority of the engine cycle, pulsed to −40 kV at the ignition point and returned to −7 kV after the spark discharge takes place. The secondary electrode 109 for spark ignition, connected to the metallic outer casing 101, will be maintained earthed throughout the cycle. The application of a 7 kV potential across the spark plug electrodes 104, 109 will not impair the performance of the spark plug and will be insufficient to cause sparking.

Also in the proposed device, a potential difference of approximately 7 kV (in the range 2 kV to 14 kV) is maintained, consistently, between the shared electrode system 104, 105 and the secondary atomiser electrode 118. The shared electrode system 104, 105 can be held at a negative or positive potential with respect to the secondary atomiser electrode 118, but preferably is held negative. The 7 kV potential causes a corona discharge from the sharp edge 117 of the electrodes 105, which charges the fuel passing between the atomiser electrodes 118.

The shared electrode system 104, 105 will alternate between −7 kV and −40 kV, depending on the point in the engine cycle. In order for a 7 kV potential difference to be maintained between the atomiser electrodes 105 and 118, the voltage of the secondary atomiser electrode 118 will have to be varied and synchronised with the shared electrode system 104, 105, alternating between 0 kV and −33 kV. An electronic control unit for providing the −40 kV pulse, timed as required to achieve effective combustion of fuel, is shown at 125 and is essentially common to those widely employed in current spark ignition using a coil with a large number of windings on the secondary circuit. Means for providing the voltage differential of −7 kV at all times are illustrated in FIG. 5. FIG. 5 also shows a linking bridge 139 between the two sources of high voltage potential, i.e. a source 130 supplying energy for the ignition spark and the source 131 supplying the energy source for the atomiser. This linking bridge 139 sustains the differential of −7 kV between the primary and secondary electrodes 105, 118 of the atomiser at all times. Thus at the time when voltage in the ignition conductor 104 rises to −40 kV, the voltage in the atomiser conductor 119 simultaneously rises to −33 kV.

Referring now to FIG. 5, the source of ignition potential for the primary spark electrode 104 is indicated at 130. This comprises a conventional ignition coil comprising an iron core 135, a primary coil 136 and a secondary coil 137. The HT lead 107 is connected to the terminal 107A. A further lead 138 connects the ignition voltage source 130 to the linking bridge 139 formed of four diodes arranged to provide four connection points 141, 142, 143 and 144. The lead 138 is connected to the connection point 142 and the charge voltage lead 120 is connected to the connection point 144. A capacitor 145 is connected across the connection points 142 and 144.

The source 131 for the polarising or charge voltage for producing atomisation is driven by DC power supplied to a fast switch 146 at an input terminal 147. A timing pulse is supplied to a further terminal 148 of the fast switch 146, and is driven in synchronisation with the conventional timing circuit for triggering the ignition coil 130. The output of the fast switch 146 is fed to an oscillator 149 the output of which is fed through a primary coil 150 of a polarising transformer 151. A secondary coil 152 of the transformer 151 is connected across the connection points 141, 143 of the bridge 139.

Reference will now be made to FIGS. 4, 4*a* and 4*b*, which show in axial section a design rig used to determine certain parameters of the fuel injection assembly embodying the invention shown in FIG. 3. FIG. 4 shows a single orifice fuel atomiser rig 260, in which the distance between an end tip 217 of a power supply (high voltage) electrode 205 and an earth electrode 218 can be varied. An end cap 208 of the atomiser rig is illustrated to show details of the mounting defining an orifice 215 in order to indicate the variable position which the orifice 215 can occupy in relation to the tip 217 of the electrode 205.

It will be seen that the orifice 215 is defined by a steel tube (forming the earth electrode 218) with a through hole 215 along its axis. The bore of the hole is 80 microns (0.080 mm). This orifice tube 218 is pressed into a steel probe carrier 260 of the same axial length (2.82 mm). The tube 218 fits sufficiently tightly within the carrier 260 so as not to be dislodged by the pressure of the fuel when fuel is flowing through the atomiser. The steel probe carrier 260 fits within a brass bush 261 which is firmly fixed into the ceramic end of the atomiser cap 208. The brass bush 261 also provides a conductive path to earth. The precision fit of the steel probe 260 within the brass bush 261 is such as to prevent inadvertent movement due to pressure of the flowing fuel but it is capable of sliding movement inwards, i.e., towards the power supply electrode 205 which movement can be controllably provided by a micrometer (not shown). The steel probe 260 also has a short external thread at its outer end, by means of which it can be withdrawn away from the power supply electrode 205.

When used to determine electrode spacing for the embodiment of FIG. 3, the rig of FIG. 4 is mounted vertically with the orifice 215 directed downwards to produce a jet of fuel which can be clearly observed. Standard fuel is supplied to the atomiser at a pressure of 5 Bar and the jet can be seen as a clear, needle shaped stream issuing into the receptacle below without breaking up into droplets. When progressively increasing negative voltage is applied to the electrode 205, a change in the form of the jet is visible. When the voltage reaches approximately 3 kV, the form of the jet can be seen to begin to break up before reaching the receptacle, i.e. a distance of approximately 500 mm from the orifice. This effect becomes progressively more extreme until the voltage reaches 5 to 8 kV, when shattering of the jet stream is evident from approximately 10 mm distance from the orifice. Further increase in applied voltage produces no greater effect above approximately 8 kV, until the limit of the insulation at the external terminal of the electrode is reached at about 11 kV.

A series of tests was carried out with this apparatus in order to determine variations in the atomising performance with varying the critical distance between the tip of the electrode and the inner end of the orifice. The critical distance illustrated in FIG. 4 is 150 microns (0.150 mm). The objective of investigating this variable is in order to observe the variation in the strength of the electric field in the region between the tip of the power supply electrode 205 and the nearest earth point which is formed by the inner end of the orifice tube 218.

The maximum critical distance at which some atomising effect was visible as a result of voltage applied to the power supply electrode 205 was approximately 500 microns (0.500 mm). However, visible improvement in atomisation was apparent as the critical distance was reduced from this value. Best atomising performance was apparent at about 150 microns. Performance with critical distance below 100 microns became intermittent rather than smoothly consistent, although atomisation was still apparent at a critical distance as small as 25 microns.

From this experiment, it can be concluded that the preferred range for the critical distance is from 25 microns to 500 microns. Within this range the highly preferred range is 125 to 200 microns. The fuel flow rate was measured at the supply pressure of 5 Bar which was used throughout the test series. It was found to be 26.1 ml per minute. No significant effects due to variation of the applied voltage were found over the range of critical distance observed i.e. the optimum effect remained within the range approximately 5–8 kV.

Returning now to consideration of FIGS. 3 and 5, an objective of the design is to prevent the rapid voltage change for igniting the fuel/air mixture from seriously influencing the electrical charge imparted to the fuel droplets. The various electrical circuits should be designed to have high immunity to mutual disturbance by adherence to the principles of electromagnetic compatibility. The fuel charge is injected into the combustion area by pulsed timing of the injection pressure, and is charged with a particular polarity by imposing a strong potential gradient. The object is to make the charged droplets repel one another after emerging from the nozzle apertures.

The spark-plug voltage-time wave can be produced as the result of contacts interrupting a flow of 2 amps through the primary of an ignition coil. The energy of the collapsing magnetic field is released into a capacitor, resulting in a damped oscillation estimated at about 3 kHz. Typically the secondary winding steps up the output to 40 kV peak, which is enough to jump a gap of 0.030" (0.75 mm) at 10 bar pressure. Variants (such as electronic ignition) may deliver the energy stored in a capacitor charged to 250 V, into the primary of a similar coil used as a step-up transformer. The resulting oscillatory waveform is similar.

The engine rotation can be used to control the timing of all events. A toothed wheel and magnetic transducer can subdivide 180 teeth at 2 degrees with a precision of about 0.1 deg. Alternatively a quartz clock and suitable dividers can perform the function.

The voltages used are important. The ionising potential preferably needs to be held stable within 10 percent. The supply at 3 to 7 kV feeds a full-wave bridge rectifier with good regulation. The incoming a.c. voltage is generated by a four-element switching-transistor bridge fed into a coil on a transformer-core which is physically separated by a polythene disk distant enough from the secondary to resist sparks jumping across the windings. Energy content (expressed to joules) and air/fuel ratio determine ignition success.

The injector chamber 114 is built as a bowl-shaped assembly with the copper ring-seal 128 allowing the atomiser assembly 108 to be aligned before closing the end of the unit with the upper portion 101B. The nozzle apertures 115 are metallised at 118 and connected to the voltage source via the thin rod 119. The ioniser coronet shaped electrodes 105 can be electron-beam welded in place on the spark-plug core rod 104 before final assembly. The electrical potential gradient across the electrodes 105 to 118 is held substantially constant by a capacitor of low impedance connected between the ioniser electrode 105 and the metallised aperture electrode array 118.

Alternative arrangements are feasible in principle. It can be arranged to carry the electrode system 105 of the polariser up and down in potential by a negative swing of 40 kilovolts, because it forms part of the same metal structure as the ignitor electrode 104. Also it can be arranged as far as possible, to keep the polarising circuit 105, 118 and ignitor circuit 104, 109 electrically independent of each other. This requires the polarising circuit to act as a unit having low impedance at high rates of change of voltage. The electrical path from the polariser crown electrode 105 to the perforated electrode 118 should preferably be capacitive. The pigtail connection 122 is needed to ground the shield tube 121 to the housing 101. The simple electrostatic shield 121 for the connection to the polariser, reduces capacitance from the ignitor impulse rod 104B to downlead 119.

The invention claimed is:

1. A fuel injection assembly comprising a main structure for mounting on an internal combustion engine, the main structure having a number of orifices for injecting fuel directly into the combustion chamber of the internal combustion engine, the main structure also having mounted thereon an electrode structure for atomizing and igniting the fuel including a spark electrode adapted to provide a fuel ignition spark for the internal combustion engine;

characterized in that the electrode structure includes charge electrodes; means positioning said charge electrodes to provide an electric field which passes through a flow of fuel for charging fuel particles in the flow to improve atomization; and said main structure having three electrical connectors adapted to be connected to three different potentials, with means connecting said three connectors to said charge electrodes and said spark electrode to allow provision of a relatively low potential difference for atomizing the fuel and a relatively high potential difference for igniting the fuel.

2. An assembly according to claim 1 in which the said spark electrode is a primary spark electrode and said electrode structure includes at least one secondary spark electrode spaced apart from the primary spark electrode to provide a fuel ignition spark for the internal combustion engine; the said charge electrodes comprising at least one primary charge electrode and at least one secondary charge electrode spaced apart across a fuel flow path of the assembly.

3. An assembly according to claim 2, in which the said at least one secondary charge electrode is connected to an earth connector and the said at least one primary charge electrode is connected to a source of potential for providing the said atomization of fuel.

4. An assembly according to claim 2, in which the said at least one primary charge electrode is connected to the said primary spark electrode and the assembly includes a voltage supply assembly arranged to supply varying potentials to the primary spark electrode and to the secondary charge electrode the voltage supply assembly being arranged to vary the potentials supplied during a firing cycle of an internal combustion engine so as to maintain a potential difference between the primary charge electrode and the secondary charge electrode at a first, constant, value for atomization of fuel, and to provide a potential difference between the primary spark electrode and the said at least one secondary spark electrode which varies between a first preselected value sufficiently small to avoid generation of an ignition spark, and a second preselected value sufficiently large to provide an ignition spark.

5. An assembly according to claim 1 in which the main structure includes an annular distribution gallery positioned around a central axis of the main structure, said charge electrodes comprising at least one charge electrode providing an annular edge facing into the distribution gallery and at least one charge electrode being positioned in an annular configuration around the distribution gallery on a surface of a wall thereof.

* * * * *